US007862454B2

(12) United States Patent
Umezawa

(10) Patent No.: US 7,862,454 B2
(45) Date of Patent: Jan. 4, 2011

(54) GOLF BALL

(75) Inventor: Junji Umezawa, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 225 days.

(21) Appl. No.: 12/270,968

(22) Filed: Nov. 14, 2008

(65) Prior Publication Data

US 2010/0125006 A1 May 20, 2010

(51) Int. Cl.
*A63B 37/06* (2006.01)

(52) U.S. Cl. ..... 473/378

(58) Field of Classification Search ..... 473/378, 473/373, 374

See application file for complete search history.

(56) References Cited

U.S. PATENT DOCUMENTS 4,839,116 A 6/1989 Puckett et al.
5,005,838 A 4/1991 Oka
5,209,485 A 5/1993 Nesbitt et al.
5,273,287 A 12/1993 Molitor et al.
5,695,413 A 12/1997 Yamagishi et al.
5,971,870 A 10/1999 Sullivan et al.
2007/0197313 A1 * 8/2007 Watanabe et al. ..... 473/371
2007/0259737 A1 * 11/2007 Watanabe ..... 473/371

FOREIGN PATENT DOCUMENTS

JP 02-295573 A 12/1990
JP 04-117969 A 4/1992
JP 2007-301357 A 11/2007

* cited by examiner

*Primary Examiner*—Raeann Trimiew
(74) *Attorney, Agent, or Firm*—Sughrue Mion, PLLC

(57) ABSTRACT

The present invention provides a golf ball composed of a core and a cover having an outside surface on which are formed a plurality of dimples. Letting BV and CV be the initial velocity (m/s) of, respectively, the ball and the core as measured by a method using an initial velocity measuring apparatus of the same type as a USGA drum rotation-type initial velocity instrument and letting BE and CE be the deflection (mm) of, respectively, the ball and the core when compressed under a final load of 1,275 N (130 kgf) from an initial load of 98 N (10 kgf), the ball initial velocity BV is from 70.0 to 76.0 m/s and the ball satisfies the formula $0 \leqq (CV-BV)-(CE-BE) \leqq 2$. The golf ball of the invention has a flight distance that can be reduced compared with official golf balls currently in use, yet has the same good feel on impact and excellent controllability, scuff resistance and durability to repeated impact as a game ball.

6 Claims, 2 Drawing Sheets

DIMPLE I

DIMPLE II

GOLF BALL

BACKGROUND OF THE INVENTION

The present invention relates to a golf ball which has a flight distance that can be reduced compared with official golf balls currently in use, yet has the same good feel on impact and excellent controllability and durability as a game ball, thus making it suitable for use not only as a game ball, but also as a range ball.

Recently, in the following two cases, there has been an increased desire for reduced-flight golf balls.

The first case has to do with the fact that, at "driving range" type golf ball practice ranges, because the practice ranges cannot be made sufficiently large in size, balls hit by golfers end up flying out of the range. Reduced-flight golf balls are desired in order to resolve this problem.

The second case concerns golf courses where the distance from the teeing ground to the green is short. On such courses, to enjoy the game using distance clubs such as drivers, there is a desire on the part of golfers to limit the distance traveled by the ball.

Of the golf balls that have been disclosed to date, a few are golf balls which intentionally restrict the flight performance or are designed to travel a short distance. For example, JP-A 60-194967 describes a short distance golf ball which includes a foam-molded thermoplastic resin polymer and filler material, and has a density gradient that increases along the radius thereof from the center to the surface of the ball.

However, this golf ball undergoes an excessive loss of distance not only at high head speeds, but also at low head speeds, making it too disadvantageous to the golfer in competition.

U.S. Pat. No. 5,209,485 teaches a golf ball which has a low rebound and a reduced distance. However, this ball has a high hardness and thus an unpleasant feel on impact.

U.S. Pat. No. 5,273,287 discloses a large-diameter golf ball having a diameter of from 1.70 to 1.80 inches (43.18 to 45.72 mm), a weight of not more than 1.62 ounces, and a dimple surface coverage of at least 70% relative to the spherical surface of the ball. Yet, because the ball is larger than normal, it feels strange to the player. Moreover, the feel on impact has not been improved.

U.S. Pat. No. 5,971,870 and U.S. Pat. No. 5,695,413 describe golf balls having a soft core. However, because the purpose of these inventions is to provide a good flight performance, they differ from the present invention in their fundamental aims.

JP-A 2007-301357 discloses golf balls for which properties such as the initial velocity, amount of deformation and cover hardness are specified. However, such golf balls do not exhibit a sufficient reduction in distance, in addition to which they have a large deflection at the time of impact and thus too soft a feel. Also, JP-A 2-295573 and JP-A 4-117969 disclose golf balls which are intended to have a low flight trajectory, but these balls lack excellence with respect to all of the following: feel, controllability and durability.

SUMMARY OF THE INVENTION

It is therefore an object of the present invention to provide a golf ball which has a flight distance that can be reduced compared with official golf balls currently in use, yet has the same good feel on impact and excellent controllability, scuff resistance and durability to repeated impact as a game ball.

The inventors have found, from extensive investigations aimed at achieving the above object, that by designing a golf ball so as to satisfy the following specific formula (I)

$$0 \leqq (CV-BV)-(CE-BE) \leqq 2,$$

where CV is the initial velocity of the core, BV is the initial velocity of the ball, CE is the deflection when the core is compressed under a specific load, and BE is the deflection when the ball is compressed under a specific load, the distance traveled by the ball can be reduced compared with official balls currently in use, yet the ball has the same good feel on impact and excellent controllability and durability as a game ball.

More specifically, above formula (I) is an indicator of the balance of rebound versus deflection between the core and the golf ball (finished product). When above formula (1) satisfies a specific numerical range, the above-described effects of the invention can be effectively achieved.

Accordingly, the invention provides the following golf balls.

[1] A golf ball comprising a core and a cover having an outside surface on which are formed a plurality of dimples, wherein, letting BV and CV be the initial velocity (m/s) of, respectively, the ball and the core as measured by a method using an initial velocity measuring apparatus of the same type as a USGA drum rotation-type initial velocity instrument and letting BE and CE be the deflection (mm) of, respectively, the ball and the core when compressed under a final load of 1,275 N (130 kgf) from an initial load of 98 N (10 kgf), the ball initial velocity BV is from 70.0 to 76.0 m/s and the ball satisfies formula (I) below:

$$0 \leqq (CV-BV)-(CE-BE) \leqq 2.$$

[2] The golf ball of [1] which further satisfies formula (II) below:

$$1000 \leqq \text{Shore } D \text{ hardness of cover} \times (BV/BE) \leqq 1{,}600.$$

[3] The golf ball of [1] which further satisfies formula (III) below:

$$0.015 \leqq (BE/CE)/\text{Shore } D \text{ hardness of cover} \leqq 0.023.$$

[4] The golf ball of [1] which, in the relationship between total dimple volume ($mm^3$), dimple depth (mm) and dimple surface coverage (%), further satisfies formula (IV) below:

$$28 \leqq \text{total dimple volume}/(\text{dimple depth} \times \text{dimple surface coverage}) \leqq 35.$$

[5] The golf ball of [1], wherein the dimples have a total volume of from 400 to 480 $mm^3$.

[6] The golf ball of [1], wherein the core initial velocity CV is from 70.0 to 78.0 m/s.

BRIEF DESCRIPTION OF THE DIAGRAMS

DETAILED DESCRIPTION OF THE INVENTION

Figure 1:
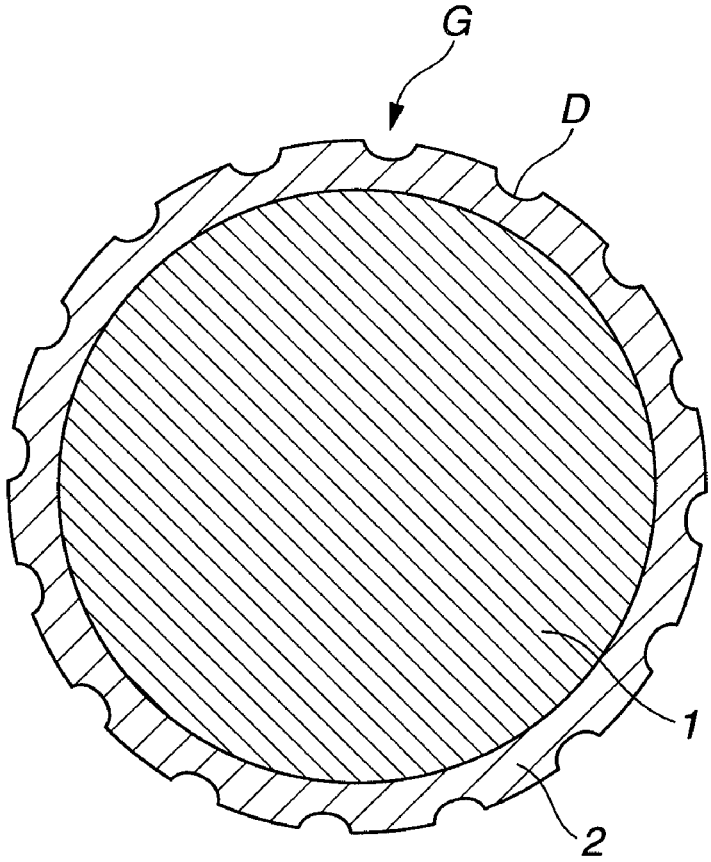
FIG. 1 is a sectional view showing the internal structure of a golf ball according to an embodiment of the present invention.

The invention is described more fully below.

The golf ball of the invention is characterized by using the initial velocity (m/s) of, respectively, the ball and the core as measured by a method using an initial velocity measuring apparatus of the same type as a USGA drum rotation-type initial velocity instrument, using the deflection (mm) of, respectively, the ball and the core when compressed under a final load of 1,275 N (130 kgf) from an initial load of 98 N (10 kgf), and setting these physical property values so as to satisfy formula (I) below:

$$0 \leqq (CV/BV)-(CE/BE) \leqq 2$$

The ball initial velocity BV and core initial velocity CV are measured values which are based on the initial velocity measurement method set forth in the Rules of Golf and are measured using an initial velocity measuring apparatus of the same type as the USGA drum rotation-type initial velocity instrument approved by the R&A. That is, the ball or core is held isothermally in a 23±1° C. environment for at least 3 hours, then tested in a chamber at a room temperature of 23±2° C. The ball is hit using a 250-pound (113.4 kg) head (striking mass) at an impact velocity of 143.8 ft/s (43.83 m/s). One dozen balls are each hit four times. The time taken to traverse a distance of 6.28 ft (1.91 m) is measured and used to compute the initial velocity (m/s) of the ball. This cycle is carried out over a period of about 15 minutes.

The initial velocity BV of the golf ball is at least 70 m/s, preferably at least 71 m/s, and more preferably at least 72 m/s, but is not more than 76 m/s, preferably not more than 75.5 m/s, and more preferably not more than 75 m/s. If this value is too large, it may not be possible to sufficiently restrict the distance traveled by the ball on shots with a number one wood (W#1). On the other hand, if this value is too small, the distance traveled by the ball may decrease excessively not only on shots with a W#1, but even on shots with an iron.

The deflection BE of the ball when compressed under a final load of 1,275 N (130 kgf) from an initial load of 98 N (10 kgf) is preferably at least 2.0 mm, more preferably at least 2.2 mm, and even more preferably at least 2.4 mm, but preferably not more than 4.0 mm, more preferably not more than 3.8 mm, and even more preferably not more than 3.6 mm. If this value is too small, the feel on impact may be too hard and the ball may travel too far, as a result of which the objects of the invention may not be achieved. On the other hand, if this value is too large, the feel on impact may be too soft and the ball may have a poor durability.

The core initial velocity CV is preferably at least 70 m/s, more preferably at least 71 m/s, and even more preferably at least 72 m/s, but is preferably not more than 78 m/s, more preferably not more than 77 m/s, and even more preferably not more than 76 m/s. If this value is too large, it may not be possible to sufficiently restrict the distance traveled by the ball on shots with a W#1. On the other hand, if this value is too small, the distance traveled by the ball may decrease excessively not only on shots with a W#1, but even on shots with an iron.

The deflection CE of the core when compressed under a final load of 1,275 N (130 kgf) from an initial load of 98 N (10 kgf) is preferably at least 2.3 mm, and more preferably at least 2.5 mm, but preferably not more than 5.0 mm, and more preferably not more than 4.7 mm. If this value is too small, the feel on impact may be too hard and the ball may travel too far, as a result of which the objects of the invention may not be achieved. On the other hand, if this value is too large, the feel on impact may be too soft and the ball may have a poor durability. The core has a diameter of preferably at least 35 mm, more preferably at least 36 mm, and even more preferably at least 37 mm, but preferably not more than 41 mm, more preferably not more than 40.5 mm, and even more preferably not more than 40 mm. If the diameter is too large, the distance traveled by the ball on shots with a driver may be excessive. On the other hand, if the diameter is too small, the ball may incur too much spin on shots with an iron, which may result in an excessive decrease in distance.

In the present invention, it is critical that the following formula (I) be satisfied:

$$0 \leqq (CV-BV)-(CE-BE) \leqq 2.$$

That is, it is essential for the value of (CV−BV)−(CE−BE) to be at least 0 but not more than 2, and preferably at least 0.5 but not more than 1.5. At a (CV−BV)−(CE−BE) value which is smaller than the above range, the ball has a high rebound relative to the core rebound or the ball has a small deflection relative to the core, resulting in a ball which has a poor controllability in the short game, has a poor feel and a poor durability on repeated impact, or travels too far on shots with a driver. On the other hand, at a (CV−BV)−(CE−BE) value which is larger than the above range, the ball has a low rebound relative to the core or the ball has a large deflection relative to the core, resulting in a ball which incurs excessive spin on shots with a driver, is too different from a game ball and thus disconcerting to the golfer, or does not travel far enough on shots with an iron.

As mentioned above, in the present invention, it is necessary to set the physical property values of initial velocity and deflection between the golf ball core and the golf ball itself within the above-described numerical range. To this end, by having, for example, a core material, a method of manufacturing the core, a material making up the cover which encloses the core, and a method of forming the cover which are in keeping with the descriptions provided below, a golf ball that satisfies above formula (I) can be obtained.

Core Material

An elastic core made of rubber may be used as the core material which satisfies the above formula and has a deflection (amount of deformation) within the above-indicated range. While not subject to any particular limitation, illustrative examples of suitable core materials include blends obtained by using as the base rubber a polybutadiene rubber or any of various other synthetic rubbers such as polyisoprene rubber, butyl rubber or styrene-butadiene rubber, and blending into the base rubber known compounding ingredients such as unsaturated carboxylic acids or metal salts thereof (e.g., zinc acrylate), organic peroxides, inorganic fillers such as zinc oxide or barium sulfate, and antioxidants. In particular, if a polybutadiene rubber and an isoprene rubber are used together, the compounding ratio therebetween (polybutadiene rubber/isoprene rubber) is preferably set to from 95/5 to 50/50 (weight ratio). If a polybutadiene rubber and a butyl rubber are used together, the compounding ratio therebetween (polybutadiene rubber/butyl rubber) is preferably set to from 95/5 to 50/50 (weight ratio). In any case, it is ideal in the present invention for the base rubber to be composed primarily of polybutadiene rubber, which has an excellent rebound resilience, and to include therein a small amount of a rubber such as isoprene rubber or butyl rubber so as to limit to the extent possible the rebound resilience of the core while ensuring durability.

In formulating the core, illustrative examples of the filler added to the base rubber include barium sulfate, zinc oxide, calcium carbonate and silica (silicon dioxide). However, from the standpoint of lowering the rebound resilience of the crosslinked core structure, incorporating from 10 to 30 parts by weight of silica, calcium carbonate or the like per 100 parts by weight of the base rubber tends to satisfy above formula (I) of the invention.

Any known method may be used without particular limitation as the method of forming the core. For example, the rubber composition for the core may be masticated using a conventional mixer (e.g., a Banbury mixer, kneader or rolling mill), and the resulting compound may be formed by compression molding under applied heat using a core-forming mold. Vulcanization of the core-forming rubber composition may be carried out under, for example, a vulcanization temperature of from 100 to 200° C. and a vulcanization time of from 10 to 40 minutes.

The cover which is formed on the surface of the above-described core may be finished so that the number of cover layers is one layer or a plurality of two, three or more cover layers. For example, when the core is encased by a one-layer cover, a golf ball (two-piece golf ball) having an internal structure like that shown in FIG. 1 is obtained. In FIG. 1, the symbol 1 represents the core, 2 represents the cover, D represents a dimple, and G represents the entire golf ball. The cover is described below.

Cover Material

Although the cover material is not subject to any particular limitation, in the present invention, as explained above, there exists a need to satisfy a specific formula using the physical property values of "initial velocity" and "deflection" between the core and the ball itself. Hence, as with the core, it is necessary to select a suitable cover material so as to satisfy the formula. Specifically, preferred use may be made of a known thermoplastic resin such as an ionomer resin, a urethane resin, a polyolefin elastomer, a polyester elastomer resin or a polyamide elastomer, or of any of various elastomers. In cases where a cover of two or more layers is used, the material making up the respective cover layers may be of the same type or of different types. It is especially preferable to use an ionomer resin or a thermoplastic polyurethane elastomer. From the standpoint of increasing productivity, the use of various thermoplastic resins is preferred.

If necessary, various additives may be included in the above cover material. Examples of such additives that may be included are inorganic fillers and pigments such as zinc oxide, barium sulfate and titanium dioxide, dispersants, antioxidants, ultraviolet absorbers and light stabilizers.

Next, the Shore D hardness of the cover is described. Regardless of whether the cover is composed of a single layer or a plurality of layers, the Shore D hardness of the outermost cover layer is preferably at least 41, more preferably at least 42, and even more preferably at least 44, but preferably not more than 60, more preferably not more than 58, and even more preferably not more than 55. If the cover is too much softer than this range, the ball may incur excessive spin. Conversely, if the cover is too hard, the ball may travel too far or have a poor durability.

When the cover is composed of one layer, the cover thickness is preferably at least 0.3 mm, more preferably at least 0.5 mm, and even more preferably at least 0.7 mm, but preferably not more than 2.3 mm, more preferably not more than 2.1 mm, and even more preferably not more than 1.7 mm. When the cover is composed of a plurality of layers, it is preferable for the thickness of each respective layer to fall within the foregoing range.

Any of various known methods may be used to form the cover, such as injection molding and compression molding. The cover can easily be formed by suitably selecting such conditions as the injection temperature and time from within the ordinarily used ranges. In cases where the cover is to be composed of a plurality of layers, a cover of two or more layers may be formed around the core by first forming one cover layer over the core, then setting the resulting sphere in another injection-molding mold and forming another cover layer thereon.

Here, the following formula (II)

$$\text{Shore D hardness of cover} \times (BV/BE)$$

is preferably set to at least 1,000 but not more than 1,600, and more preferably at least 1,100 but not more than 1,500. The Shore D hardness of the cover×(BV/BE) serves as an indicator of the balance between the deflection, the rebound and the controllability.

The following formula (III)

$$(BE/CE)/\text{Shore D hardness of cover}$$

is preferably set to at least 0.015 but not more than 0.023, and more preferably at least 0.016 but not more than 0.022. The above formula (III) serves as an indicator of the balance between the deflection and the controllability.

Numerous dimples may be formed on the outside surface of the above-described ball. The total number of dimples is preferably at least 280, and more preferably at least 300, but preferably not more than 480, more preferably not more than 440, and even more preferably not more than 400. If the number of dimples is higher than the above range, the ball may have too low a trajectory. Conversely, if the number of dimples is lower than the above range, the ball may assume a high trajectory and may therefore fail to achieve a sufficient distance on shots with an iron.

Figure 2:
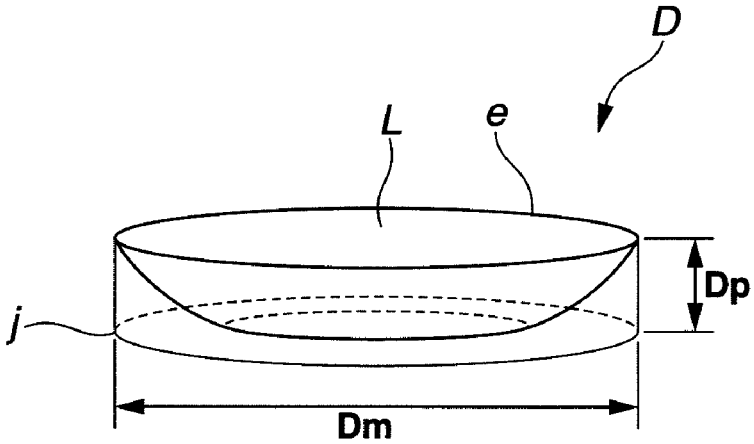
FIG. 2 is a diagram illustrating the depth of a dimple.

The dimples may be of a circular shape or a noncircular shape, illustrative examples of the latter including various polygonal shapes, dew drop shapes and elliptical shapes. Any one or combination of two or more of these shapes may be suitably used. For example, if the dimples are circular, dimples having a diameter of preferably at least 1.5 mm but not more than about 7.0 mm, more preferably at least 2.0 mm but not more than 6.0 mm, and even more preferably at least 2.5 mm but not more than 4.0 mm may be used. Also, the depth of a dimple from a flat plane circumscribed by the edge of the dimple is preferably at least 0.05 mm but not more than 0.4 mm. The depth Dp from the flat plane circumscribed by the edge of the dimple signifies, as shown in FIG. 2, the distance from the flat plane L (circle of diameter Dm) circumscribed by the edge e to the bottom plane j of the dimple (the bottom plane is identical to the foregoing flat plane of the dimple).

To reduce the distance traveled by the ball without giving the ball a disconcerting trajectory, it is desirable for the dimples to have a surface coverage (SR) on the spherical surface of the golf ball, expressed as the sum of the individual dimple surface areas defined by the border of the flat plane circumscribed by the edge of the dimple, as a proportion of the spherical surface area of the ball were it to have no dimples thereon, of preferably from 40 to 80%, more preferably from 40 to 70%, and even more preferably from 40 to 60%.

The dimples have a total volume ($mm^3$) of preferably from 400 to 480 $mm^3$, and more preferably from 410 to 470 $mm^3$.

In the relationship between total dimple volume ($mm^3$), dimple depth (mm) and dimple surface coverage (%), the value expressed by formula (IV) below:

$$\text{total dimple volume}/(\text{dimple depth} \times \text{dimple surface coverage})$$

is preferably at least 28 but not more than 35. Generally, when the dimples are shallow and the surface coverage is small, the value of above formula (IV) becomes larger. If the above value is greater than 35, the ball may travel too far or have too high a trajectory or, instead, may not rise high enough in flight. On the other hand, when the dimples are deep and the surface coverage is large, the above value becomes smaller. If the above value is less than 28, the trajectory may become too low or the ball may travel too far.

As explained above, the golf ball of the present invention has a flight distance that can be reduced compared with official golf balls currently in use, yet has the same good feel and excellent controllability, scuff resistance and durability to repeated impact as a game ball. As a result, the inventive golf ball is beneficial when using a driver on a golf driving range or a short golf course.

EXAMPLES

The following Examples of the invention and Comparative Examples are provided by way of illustration and not by way of limitation.

Examples 1 to 8, Comparative Examples 1 to 3

Rubber compositions formulated as shown in Table 1 below were prepared for the production of the golf balls in the examples of the invention and the comparative examples. These rubber compositions were suitably masticated with a kneader or roll mill, then vulcanized at 155° C. for 15 minutes to form solid cores. Numbers shown for each material in the table indicate parts by weight.

TABLE 1

| Formulation | A | B | C | D | E | F | G | H | I |
|---|---|---|---|---|---|---|---|---|---|
| Polybutadiene rubber | 85 | 85 | 95 | 80 | 100 | 100 | 95 | 95 | 85 |
| Polyisoprene rubber | 15 | 15 | | 10 | | | | | 15 |
| Butyl rubber | | | 5 | 10 | | | 5 | 5 | |
| Zinc acrylate | 28.0 | 26.0 | 28.0 | 28.0 | 31.0 | 31.0 | | 28.0 | 23.0 |
| Peroxide (1) | 0.6 | 0.6 | 0.6 | 0.6 | 0.6 | 0.6 | 0.6 | 0.6 | 0.6 |
| Peroxide (2) | 0.6 | 0.6 | 0.6 | 0.6 | 0.6 | 0.6 | 0.6 | 0.6 | 0.6 |
| Zinc oxide | 5 | 5 | 5 | 5 | 5 | 11.1 | 5 | 5 | 5 |
| Antioxidant | 0.1 | 0.1 | 0.1 | 0.1 | 0.1 | 0.1 | 0.1 | 0.1 | 0.1 |
| Calcium carbonate | 11.2 | 12.4 | 11.2 | 11.2 | 20.4 | 0 | 26 | 23.1 | 14.3 |
| Zinc salt of pentachlorothiophenol | 0 | 0 | 0 | 0 | 1 | 1 | 0 | 0 | 0 |
| Zinc stearate | 0 | 0 | 0 | 0 | 0 | 0 | 0 | 0 | 0 |

Note:
Numbers in the table indicate parts by weight.
The above materials are described below.
Polybutadiene rubber: Produced by JSR Corporation under the trade name BR01.
Polyisoprene rubber: Produced by JSR Corporation under the trade name IR2200.
Butyl rubber:Produced by Japan Butyl Co., Ltd. under the trade name Bromobutyl 2222.
Zinc acrylate: Produced by Nihon Jyoryu Kogyo Co., Ltd.
Peroxide (1): Produced by NOF Corporation under the trade name Percumyl D.
Peroxide (2): Produced by NOF Corporation under the trade name Perhexa C-40.
Zinc oxide: Produced by Sakai Chemical Industry Co., Ltd.
Zinc stearate: Produced by NOF Corporation under the trade name Zinc Stearate G.
Antioxidant: Produced by Ouchi Shinko Chemical Industry Co., Ltd. under the trade name Nocrac NS-6.
Calcium carbonate: Produced by Shiraishi Calcium Kaisha, Ltd. under the trade name Silver-W.

After molding and vulcanization of the core as described above, the core was set in a mold for injection-molding the cover, and a cover formulation having the composition shown in Table 2 below was injection-molded around the core.

TABLE 2

| | Formulation No. | | | | | | |
|---|---|---|---|---|---|---|---|
| | 1 | 2 | 3 | 4 | 5 | 6 | 7 |
| Himilan 1557 | | | 30 | | 50 | | |
| Himilan 1601 | | | | | 50 | | |
| Himilan 1605 | | | | | | 50 | |
| Himilan 1706 | | | | | | 50 | |
| Himilan 1855 | | | 20 | | | | |
| Himilan 7331 | | | 50 | | | | |
| Pandex T8295 | 50 | | | 100 | | | |
| Pandex T8290 | 50 | 75 | | | | | |
| Pandex T8283 | | 25 | | | | | 100 |
| Polyisocyanate compound | 9 | 9 | | 9 | | | 9 |
| Thermoplastic elastomer | 15 | 15 | | 15 | | | 15 |
| Titanium oxide | 3.5 | 3.5 | 2 | 3.5 | 2 | 2 | 3.5 |
| Polyethylene wax | 1.5 | 1.5 | | 1.5 | | | 1.5 |

TABLE 2-continued

| | Formulation No. | | | | | | |
|---|---|---|---|---|---|---|---|
| | 1 | 2 | 3 | 4 | 5 | 6 | 7 |
| Magnesium stearate | | | 1 | | 1 | 1 | |

Note:
Numbers in the table indicate parts by weight.
The above materials are described below.
Himilan (trade name): Ionomer resins produced by DuPont-Mitsui Polychemicals Co., Ltd.
Pandex (trade name): MDI-PTMG type thermoplastic polyurethanes produced by DIC Bayer Polymer.
Polyisocyanate compound: 4,4'-Diphenylmethane diisocyanate.
Thermoplastic elastomer: A thermoplastic polyether-ester elastomer (produced by DuPont-Toray Co., Ltd. under the trade name Hytrel 4001) was used.
Titanium oxide: Produced by Ishihara Sangyo Kaisha, Ltd. under the trade name Tipaque R550.
Polyethylene wax: Produced by Sanyo Chemical Industries under the trade name Sanwax 161P.
Magnesium stearate: Produced by NOF Corporation.

Dimple arrangement I or II shown below was used on the cover surface. The mold cavity had formed therein a plurality of raised projections corresponding to dimple arrangement I or II, by means of which, simultaneous with injection molding of the cover, dimples were impressed onto the cover.

TABLE 3

Figure 3:
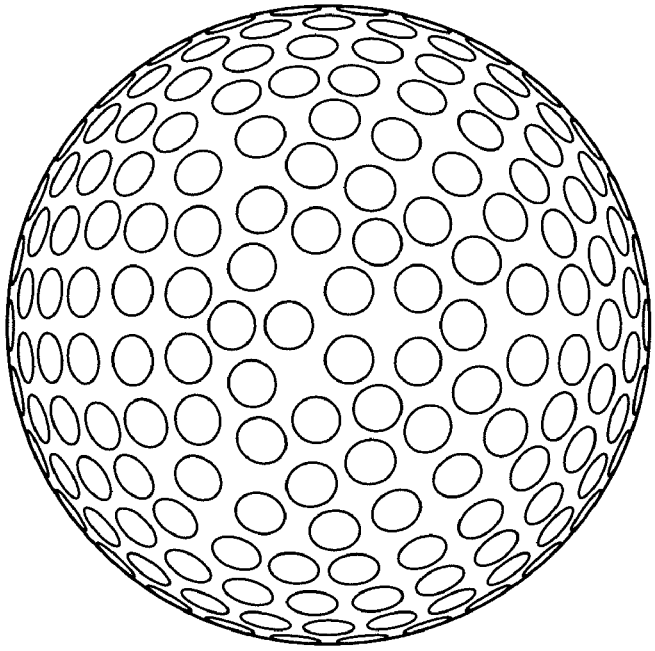
FIG. 3 is a top view of a golf ball showing dimple arrangement I.

Dimple I (dimple arrangement shown in FIG. 3)

| Type | Number | Diameter (mm) | Depth (mm) | $V_o$ | SR (%) | VR (%) | Total volume ($mm^3$) |
|---|---|---|---|---|---|---|---|
| 1 | 240 | 3.30 | 0.33 | 0.53 | 46.2 | 1.1 | 408.6 |
| 2 | 60 | 3.30 | 0.30 | 0.53 | | | |
| 3 | 6 | 3.40 | 0.16 | 0.52 | | | |
| 4 | 6 | 3.30 | 0.15 | 0.52 | | | |
| Total | 312 | | | | | | |

TABLE 4

Figure 4:
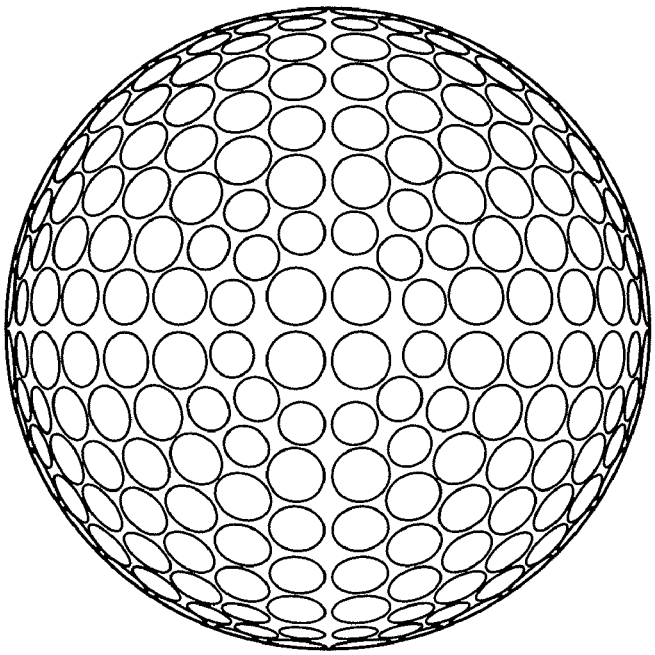
FIG. 4 is a top view of a golf ball showing dimple arrangement II.

| Dimple II (dimple arrangement shown in FIG. 4) | | | | | | | |
|---|---|---|---|---|---|---|---|
| Type | Number | Diameter (mm) | Depth (mm) | $V_o$ | SR (%) | VR (%) | Total volume ($mm^3$) |
| 1 | 40 | 4.00 | 0.21 | 0.61 | 71.0 | 1.2 | 446.7 |
| 2 | 184 | 3.80 | 0.20 | 0.61 | | | |
| 3 | 96 | 3.15 | 0.16 | 0.61 | | | |
| 4 | 32 | 4.00 | 0.23 | 0.61 | | | |
| 5 | 16 | 3.80 | 0.22 | 0.61 | | | |
| 6 | 16 | 3.05 | 0.15 | 0.61 | | | |
| 7 | 8 | 3.10 | 0.14 | 0.52 | | | |
| Total | 392 | | | | | | |

Evaluations were carried out on the physical properties, such as the thicknesses and hardnesses of the core and cover making up the balls obtained in the respective examples of the invention and the comparative examples, and on the flight performance, spin performance on approach shots, feel, and durability to repeated impact of the golf balls. The results are shown in Tables 5 and 6.

Core Deflection (CE)

The deformation (mm) of the core when compressed under a final load of 1,275 N (130 kgf) from an initial load of 98 N (10 kgf) was measured.

Ball Deflection (BE)

The deformation (mm) of the ball when compressed under a final load of 1,275 N (130 kgf) from an initial load of 98 N (10 kgf) was measured.

Shore D Hardness of Cover

The cover composition was formed under applied heat and pressure into a sheet having a thickness of about 2 mm, and the sheet was held at 23° C. for 2 weeks, following which the Shore D hardness was measured in accordance with ASTM D2240.

Initial Velocity of Ball (BV)

The initial velocity of the ball was measured using an initial velocity measuring apparatus of the same type as the USGA drum rotation-type initial velocity instrument approved by the R&A. The ball was held isothermally in a 23±1° C. environment for at least 3 hours, then tested in a chamber at a room temperature of 23±2° C. The ball was hit using a 250-pound (113.4 kg) head (striking mass) at an impact velocity of 143.8 ft/s (43.83 m/s). One dozen balls were each hit four times. The time taken to traverse a distance of 6.28 ft (1.91 m) was measured and used to compute the initial velocity (m/s) of the ball. This cycle was carried out over a period of about 15 minutes.

Initial Velocity of Core (CV)

The initial velocity of the core was measured in the same way as the initial velocity of the ball.

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of dimple surface areas defined by border of flat plane circumscribed by dimple edge, as a percentage of surface area of ball sphere were it to have no dimples thereon.

VR: Sum of volumes of dimples formed below flat plane circumscribed by dimple edge, as a percentage of volume of ball sphere were it to have no dimples thereon.

Formulas (I) to (IV) in the tables are defined below.

$$(CV-BV)-(CE-BE) \quad \text{Formula (I)}$$

$$\text{Shore D hardness of cover} \times (BV/BE) \quad \text{Formula (II)}$$

$$(BE/CE)/\text{Shore D hardness of cover} \quad \text{Formula (III)}$$

$$\text{total dimple volume}/(\text{dimple depth} \times \text{dimple surface coverage}) \quad \text{Formula (IV)}$$

Flight Performance

A number one wood (W#1) manufactured by Bridgestone Sports Co., Ltd. (TourStage X-DRIVE; loft, 10°) was set in a golf swing robot, and the distance of balls hit at a head speed (HS) of 45 m/s was measured. The results were rated according to the following criteria.

Good: Less than 220 m.

NG: 220 m or more, which is too far.

Spin Performance on Approach Shots

A sand wedge (SW) manufactured by Bridgestone Sports Co., Ltd. (TourStage X-WEDGE; loft, 58°) was set in a golf swing robot, and the distance of balls hit at a head speed (HS) of 18 m/s was measured. The results were rated according to the following criteria.

Good: Between 6,000 and 7,000 rpm (good controllability)

Fair: At least 7,000 rpm (spin was excessive, making the distance difficult to adjust)

NG: Below 6,000 rpm (low spin, resulting in poor controllability)

Feel

The feel on shots with a W#1 was rated according to the following criteria by three top amateur golfers having head speeds of from 40 to 45 m/s.

Good: Good feel.

NG: Too hard or too soft.

Durability on Repeated Impact

A ball was repeatedly hit with a W#1 at a head speed of 50 m/s, and the number of shots that had been taken with the ball when the rebound decreased by 3% on successive shots was determined. The durability was rated as follows.

Good: 100 shots or more.

NG: Less than 100 shots.

TABLE 5

| | | Example | | | | | | | |
|---|---|---|---|---|---|---|---|---|---|
| | | 1 | 2 | 3 | 4 | 5 | 6 | 7 | 8 |
| Core | Formulation | A | B | A | C | C | D | E | A |
| | Diameter (mm) | 39.3 | 39.3 | 39.3 | 39.3 | 39.3 | 39.3 | 39.3 | 39.3 |
| | Deflection (mm) | 3.2 | 3.6 | 3.2 | 3.2 | 3.2 | 3.2 | 3.3 | 3.3 |

TABLE 5-continued

| | | Example | | | | | | | |
|---|---|---|---|---|---|---|---|---|---|
| | | 1 | 2 | 3 | 4 | 5 | 6 | 7 | 8 |
| | Initial velocity (m/s) | 77.0 | 76.7 | 77.0 | 75.8 | 75.8 | 74.8 | 76.7 | 77.0 |
| Cover | Material No. | 1 | 1 | 2 | 1 | 1 | 1 | 3 | 4 |
| | Hardness (shore D) | 51 | 51 | 46 | 51 | 51 | 51 | 55 | 55 |
| | Thickness (mm) | 1.7 | 1.7 | 1.7 | 1.7 | 1.7 | 1.7 | 1.7 | 1.7 |
| Product | Deflection (mm) | 3.0 | 3.3 | 3.2 | 3.0 | 3.0 | 3.0 | 3.0 | 2.9 |
| | Initial velocity (m/s) | 75.6 | 75.4 | 75.8 | 74.7 | 74.7 | 73.6 | 75.3 | 75.6 |
| Dimples | Type | I | I | I | I | II | I | I | I |
| | Total number | 312 | 312 | 312 | 312 | 392 | 312 | 312 | 312 |
| | SR (%) | 46.2 | 46.2 | 46.2 | 46.2 | 71 | 46.2 | 46.2 | 46.2 |
| | Average depth (mm) | 0.35 | 0.35 | 0.35 | 0.35 | 0.19 | 0.35 | 0.35 | 0.35 |
| | Total volume ($mm^3$) | 456 | 456 | 456 | 456 | 447 | 456 | 456 | 456 |
| W#1 flight performance | Distance (m) | 218.0 | 215.7 | 216.5 | 213.7 | 214.4 | 210.3 | 219.5 | 219.1 |
| | Rating | good | good | good | good | good | good | good | good |
| SW approach performance | Spin rate (rpm) | 6410 | 6250 | 6590 | 6400 | 6380 | 6370 | 6060 | 6160 |
| | Rating | good | good | good | good | good | good | good | good |
| Feel | | good | good | good | good | good | good | good | good |
| Durability on repeated impact | | good | good | good | good | good | good | good | good |
| Relationship between initial velocity and deflection | Formula (I) | 1.2 | 1.0 | 1.2 | 0.9 | 0.9 | 1.0 | 1.1 | 1.0 |
| | Formula (II) | 1285 | 1165 | 1107 | 1270 | 1270 | 1251 | 1381 | 1434 |
| | Formula (III) | 0.018 | 0.018 | 0.021 | 0.018 | 0.018 | 0.018 | 0.017 | 0.016 |
| | Formula (IV) | 28.1 | 28.1 | 28.1 | 28.1 | 33.1 | 28.1 | 28.1 | 28.1 |

TABLE 6

| | | Comparative Example | | |
|---|---|---|---|---|
| | | 1 | 2 | 3 |
| Core | Formulation | G | H | I |
| | Diameter (mm) | 39.3 | 38.5 | 39.3 |
| | Deflection (mm) | 3.3 | 4.6 | 3.3 |
| | Initial velocity (m/s) | 78.4 | 75.0 | 75.5 |
| Cover | Material No. | 1 | 5 | 6 |
| | Hardness (Shore D) | 51 | 60 | 62 |
| | Thickness (mm) | 1.7 | 2.1 | 1.7 |
| Product | Deflection (mm) | 3.1 | 3.7 | 2.85 |
| | Initial velocity (m/s) | 76.6 | 75.2 | 75.9 |
| Dimples | Type | I | I | I |
| | Total number | 312 | 312 | 312 |
| | SR (%) | 46.2 | 46.2 | 46.2 |
| | Average depth (mm) | 0.35 | 0.35 | 0.35 |
| | Total volume ($mm^3$) | 456 | 456 | 456 |
| W#1 flight performance | Distance (m) | 221.9 | 215.1 | 222.7 |
| | Rating | NG | good | NG |
| SW approach performance | Spin rate (rpm) | 6370 | 5310 | 5010 |
| | Rating | good | NG | NG |
| Feel | | good | NG | NG |
| Durability on repeated impact | | good | NG | NG |
| Relationship between initial velocity and deflection | Formula (I) | 1.6 | −1.1 | −0.9 |
| | Formula (II) | 1260 | 1219 | 1651 |
| | Formula (III) | 0.018 | 0.013 | 0.014 |
| | Formula (IV) | 28.1 | 28.1 | 28.1 |

From above Tables 5 and 6, the balls obtained in Comparative Examples 1 to 3 had the following drawbacks compared with the balls obtained in the examples according to the invention.

In Comparative Example 1, the ball had an initial velocity in excess of 76.0 m/s, as a result of which the ball flew too far.

In Comparative Example 2, the Formula (I) value was less than 0 and the Formula (III) was less than 0.015. As a result, the ball had a poor controllability on approach shots, and had a poor durability to repeated impact.

In Comparative Example 3, the Formula (I) value was less than 0, the Formula (II) value exceeded 1,600, and the formula (III) value was less than 0.015. As a result, the ball had a poor controllability on approach shots, in addition to which the ball traveled too far.

The invention claimed is:

1. A golf ball comprising a core and a cover having an outside surface on which are formed a plurality of dimples, wherein, letting BV and CV be the initial velocity (m/s) of, respectively, the ball and the core as measured by a method using an initial velocity measuring apparatus of the same type as a USGA drum rotation-type initial velocity instrument and letting BE and CE be the deflection (mm) of, respectively, the ball and the core when compressed under a final load of 1,275 N (130 kgf) from an initial load of 98 N (10 kgf), the ball initial velocity BV is from 70.0 to 76.0 m/s and the ball satisfies formula (I) below:

$$0 \leqq (CV-BV)-(CE-BE) \leqq 2.$$

2. The golf ball of claim 1 which further satisfies formula (II) below:

$$1000 \leqq \text{Shore } D \text{ hardness of cover} \times (BV/BE) \leqq 1{,}600.$$

3. The golf ball of claim 1 which further satisfies formula (III) below:

$$0.015 \leqq (BE/CE)/\text{Shore } D \text{ hardness of cover} \leqq 0.023.$$

4. The golf ball of claim 1 which, in the relationship between total dimple volume ($mm^3$), dimple depth (mm) and dimple surface coverage (%), further satisfies formula (IV) below:

$$28 \leqq \text{total dimple volume}/(\text{dimple depth} \times \text{dimple surface coverage}) \leqq 35.$$

5. The golf ball of claim 1, wherein the dimples have a total volume of from 400 to 480 $mm^3$.

6. The golf ball of claim 1, wherein the core initial velocity CV is from 70.0 to 78.0 m/s.

* * * * *